United States Patent [19]

Wagnon

[11] Patent Number: 4,943,034

[45] Date of Patent: Jul. 24, 1990

[54] POWER JACK AND METHOD

[75] Inventor: Gerald E. Wagnon, Great Bond, Kans.

[73] Assignee: Wagnon Power Jack, Inc., Great Bend, Kans.

[21] Appl. No.: 42,057

[22] Filed: Apr. 24, 1987

[51] Int. Cl.[5] ..... B66F 3/22

[52] U.S. Cl. ..... 254/122; 254/126; 254/DIG. 2

[58] Field of Search ..... 254/DIG. 2, 122, 126, 254/124, 98, 103

[56] References Cited

U.S. PATENT DOCUMENTS

| | | | |
|---|---|---|---|
| 2,508,934 | 5/1950 | Berg | 254/122 |
| 3,451,655 | 6/1969 | Scott | 254/7 R |
| 3,606,252 | 9/1971 | Dorough, Jr. | 254/DIG. 2 |
| 4,084,830 | 4/1978 | Daniel, Jr. et al. | 280/6.1 |
| 4,653,727 | 3/1987 | Chang et al. | 254/DIG. 2 |
| 4,749,169 | 6/1988 | Pickles | 254/DIG. 4 |

*Primary Examiner*—Judy Hartman

*Attorney, Agent, or Firm*—John W. Carpenter

[57] ABSTRACT

An adaptor for a jack having a threadable jack shaft and a support platform that rises or lowers when the threadable jack shaft turns.

The adaptor has a housing containing a drive motor that is coupled to a drive shaft. The adaptor has an engagement bracket for engaging releasably the adaptor to the jack. Spring loaded bolts bias the engagement bracket against the face of the housing. A jack and adaptor in combination and a method for operating a jack having support aligning bars wherethrough a threadable jack shaft rotatably passes to raise or lower a support platform of the jack upon rotation.

4 Claims, 3 Drawing Sheets

FIG. 1
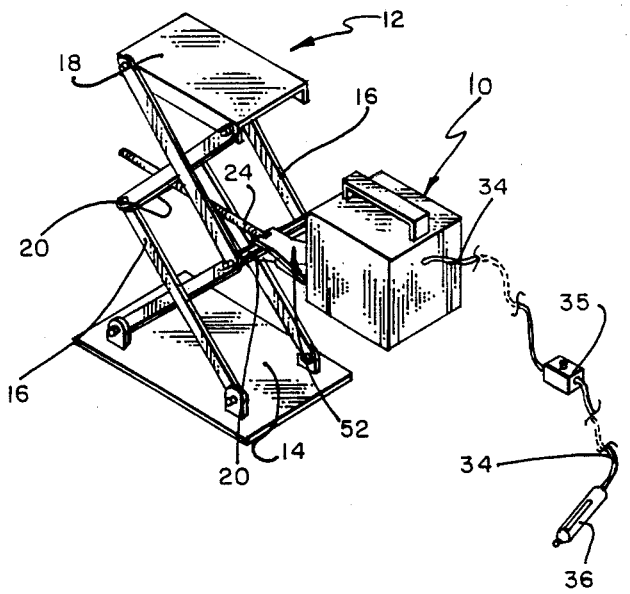
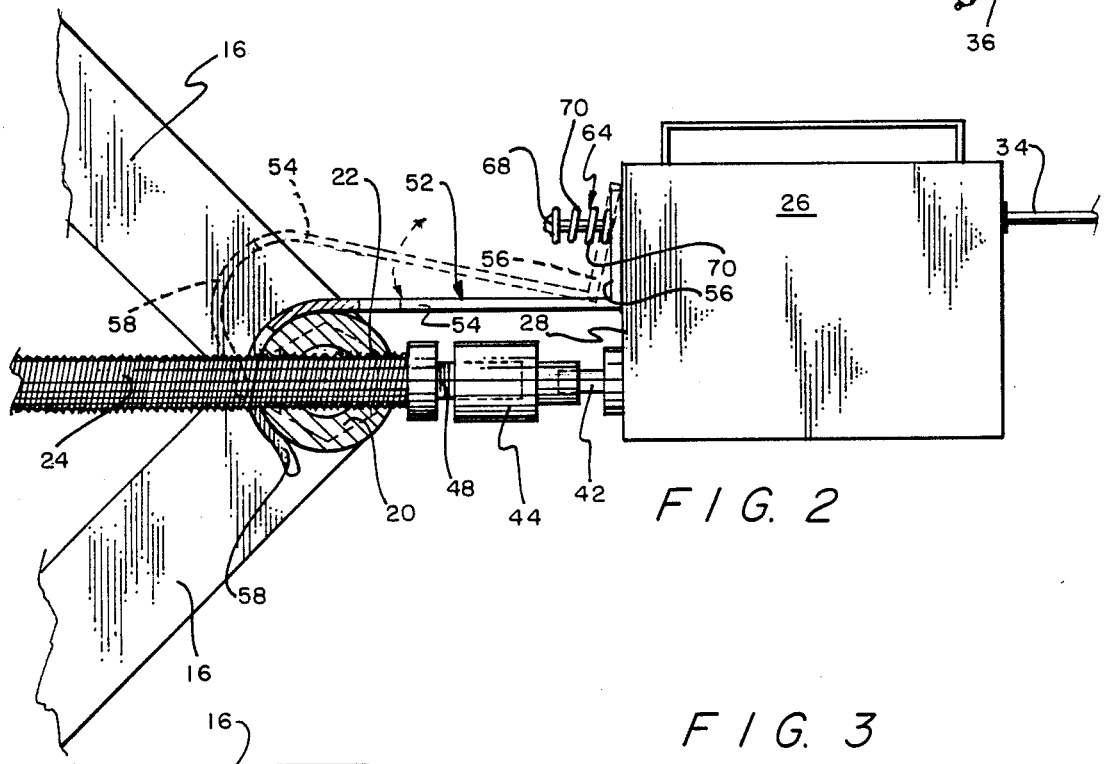
FIG. 2
FIG. 3
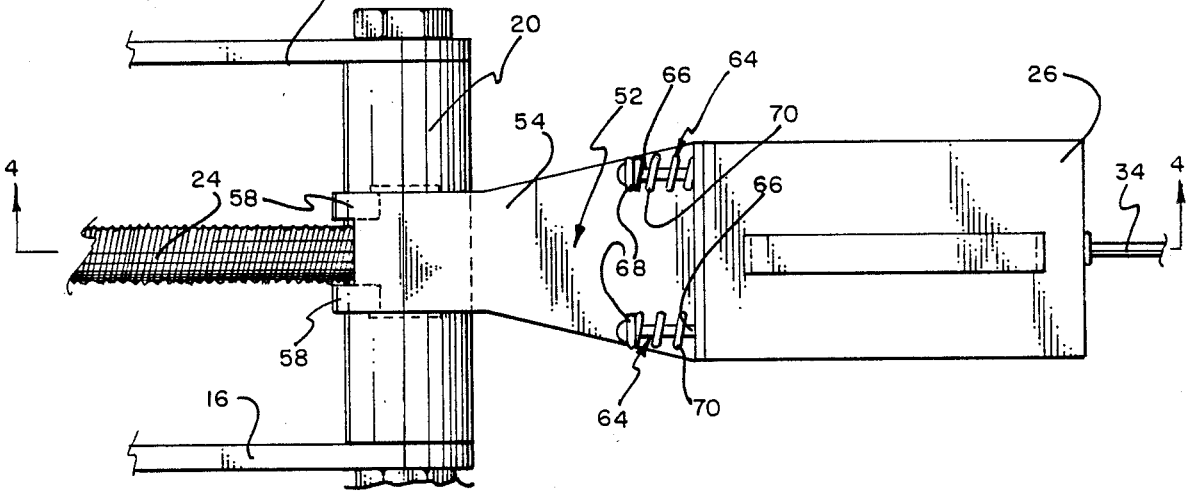

FIG. 4
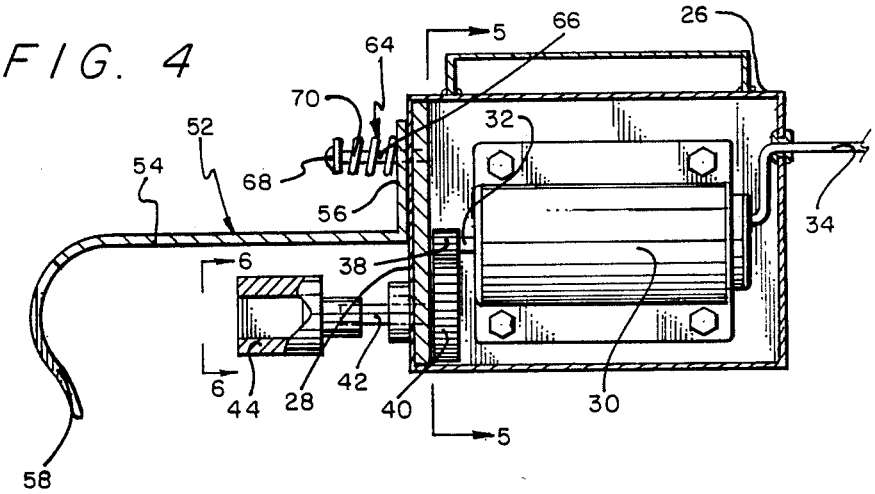
FIG. 5
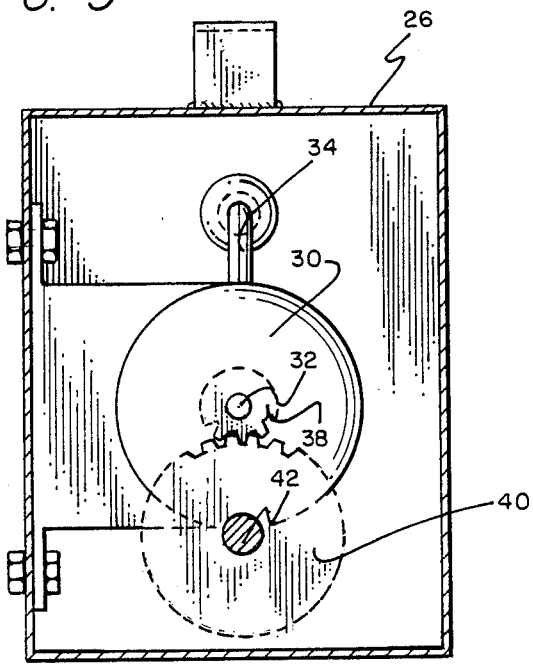
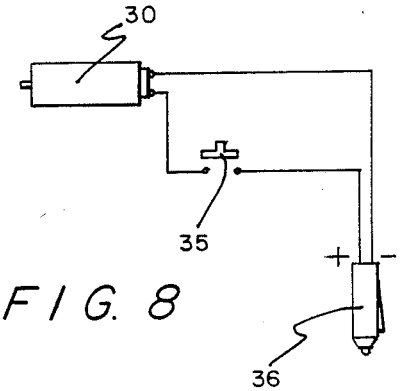
FIG. 8
FIG. 6
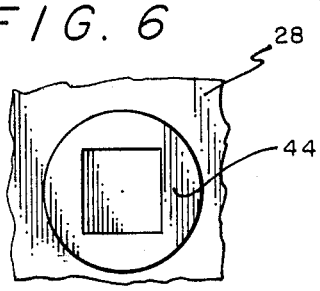
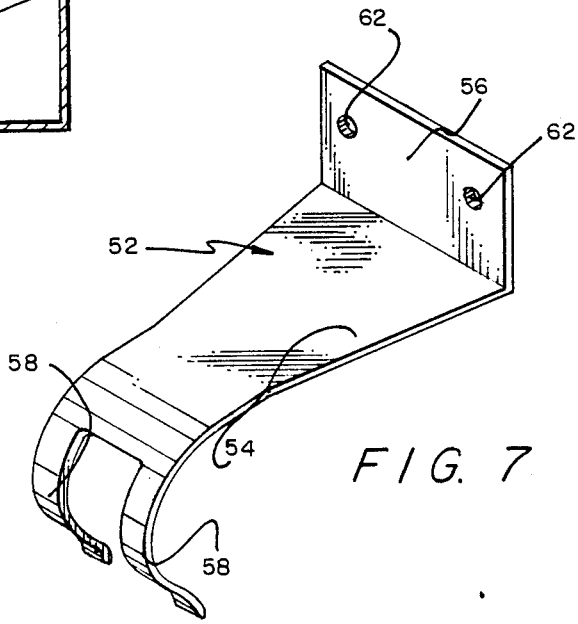
FIG. 7

FIG. 9
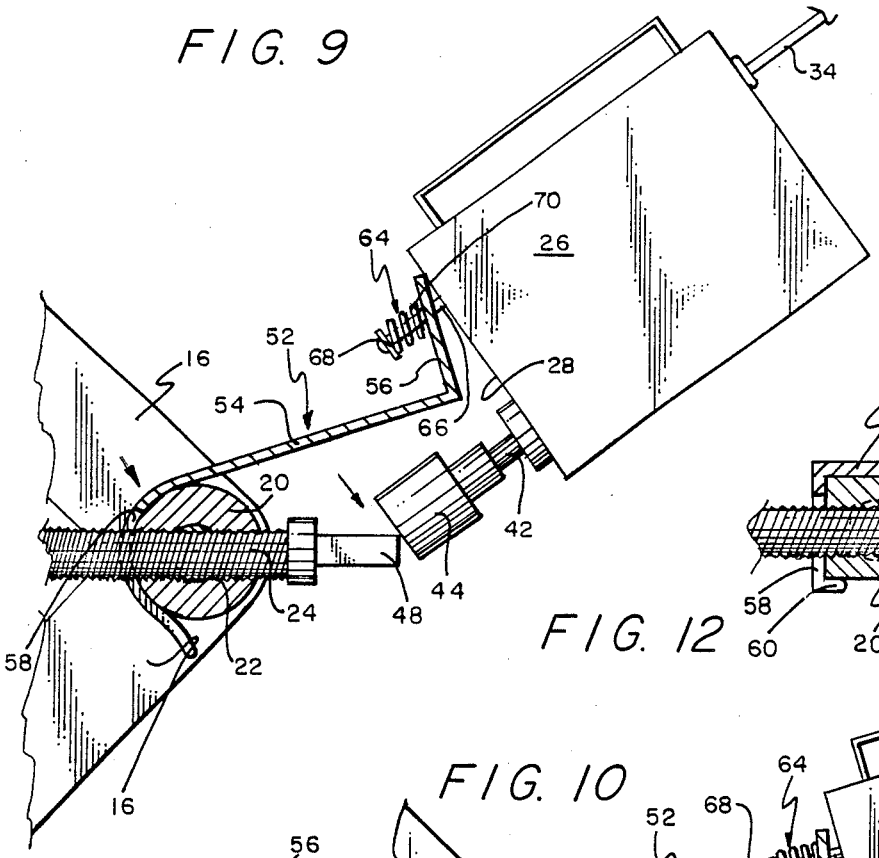
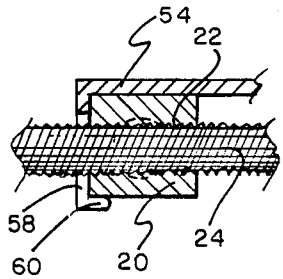
FIG. 12
FIG. 10
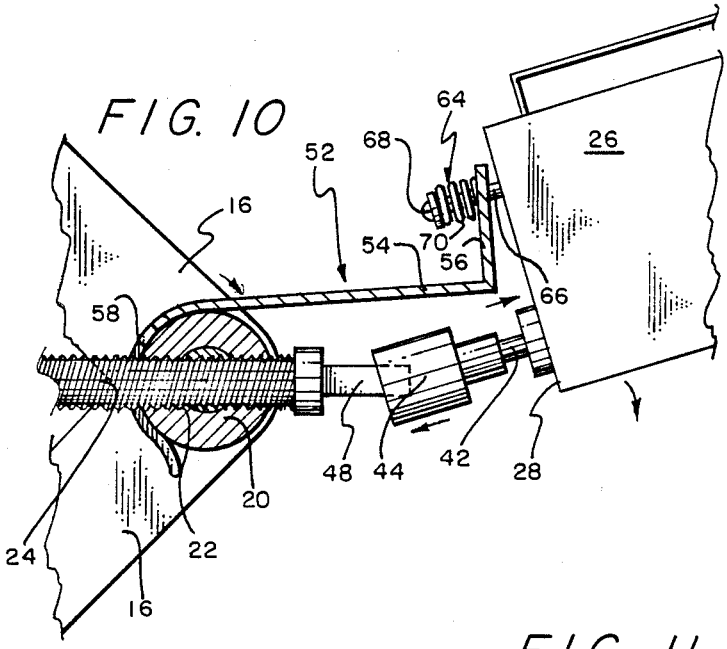
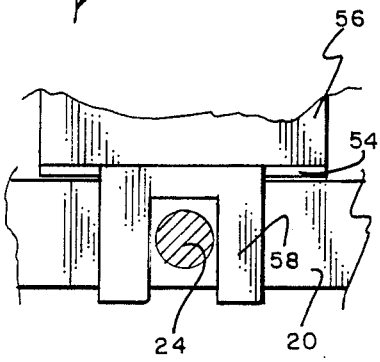
FIG. 13
FIG. 11
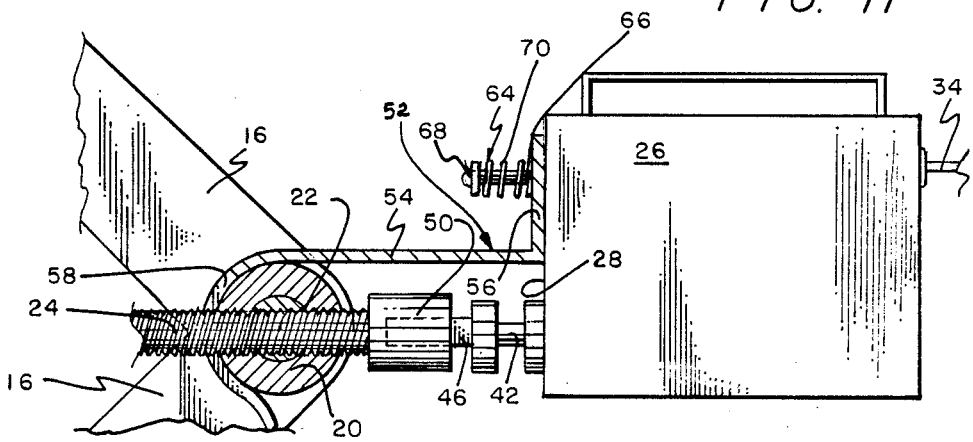

POWER JACK AND METHOD

BACKGROUND OF THE INVENTION

1. Field of the Invention

This invention relates to an adaptor for raising or lowering a screw type scissor jack. More specifically, this invention provides an adaptor that releasably engages a screw type scissor jack to mechanically jack-up a car without physically having turn a threadable jack shaft to accomplish the same, and to a method for operating a screw type scissor jack having support-aligning bars wherethrough a threadable jack shaft rotatably passes to raise or lower the support platforms of the jack upon rotation.

2. Description of the Prior Art

U.S. Pat. No. 3,062,504 by Blanchard teaches an electric automobile jack. U.S. Pat. No. 3,244,401 to Iimura discloses a motor operated screw jack. U.S. Pat. No. 3,376,019 by Weiss presents a vehicle jack. U.S. Pat. No. 3,844,535 provides a portable electric automobile jack. U.S. Pat. No. 3,392,959 by Lewis teaches a bumper jack. U.S. Pat. No. 3,606,252 to Dorough Jr. discloses a portable electric automobile jack. None of the foregoing prior art teaches or suggests the particular adaptor of this invention.

SUMMARY OF THE INVENTION

The present invention accomplishes its desired objects by broadly providing an adaptor for a jack having a threadable jack shaft and a support platform means that raises or lowers when the threadable jack shaft turns. The adaptor have a housing; a drive motor means disposed in the housing; and a drive shaft means coupled to the drive motor means. An engagement bracket means engages releasably the adaptor to the jack and prevents the adaptor from turning while the drive shaft means is engaged to and rotates the threadable jack shaft of the jack to thereby raise or lower the support platform means of the jack. The engagement bracket means is secured and biased against the face of the housing by a means for securing and biasing.

The present invention further accomplishes its desired objects by a jack and an adaptor in combination comprising a jack base; a pair of general parallel collapsible brackets pivotally secured to said jack base; and a support platform means secured pivotally to the pair of collapsible brackets. A pair of support-aligning bars connected to said pair of collapsible brackets with each support-aligning bar having a structure defining a threaded aperture. A threadable jack shaft passes rotatably through the threaded aperture of each support aligning bar such that when the threadable jack shaft rotates in a predetermined directon the two support-aligning bars are pulled towards each other causing the pair of collapsible brackets to become longer lengthwise and the support platform means to travel upwardly and such that further when the threadable jack shaft rotates in a direction opposite the predetermined direction the two support-aligning bars are pushed apart with respect to each other causing the pair of collapsible brackets to become shorter lengthwise and the support platform means to travel downwardly. The jack and adaptor combination further comprises an adaptor housing; a drive motor means disposed in the adaptor housing and a drive shaft means releasably engaged to the threadable jack shaft to rotate the same and coupled to the drive motor means. An engagement bracket means engaged releasably the adaptor to one of the support-aligning bars of the jack and prevents the adaptor from turning while the drive shaft is rotating the threadable jack shaft. The combination yet further has a means for securing and biasing the engagement bracket means against the face of the adaptor housing.

The present invention yet further accomplishes its desired objects by further broadly providing a method for operating a jack having support-aligning means wherethrough a threadable jack shaft means rotatably passes to raise or lower a support platform of the jack upon rotation comprising the steps of:

(a) pivoting an engagement bracket means against a face of a housing containing a drive motor means electrically communicating with an electrical power source and gear means which is rotated by the drive motor means, said engagement bracket means being normally secured and biased against the face of the housing by a means for securing and biasing the engagement bracket means against the face of the housing;

(b) positioning the engagement bracket means against the support-aligning means while the engagement bracket means is pivoted against the face of the housing;

(c) engaging a dirve shaft means bound to the gear means with the threadable jack shaft means;

(d) releasing the pivot of the engagement bracket means from against the face of the housing such that said means for biasing can flushly bias the engagement bracket means against the face of the housing; and (e) supplying electrical power to said drive motor means in order for the gear means, which is driven rotatably by the drive motor means, to rotate the drive shaft means in a predetermined direction causing the threadable jack shaft means to rotate in the predetermined direction and thereby raise the support platform of the jack.

Therefore, it is an object of the present invention to provide an adaptor for a jack.

It is another object of this invention to provide a jack and an adaptor in combination.

It is yet another object of this invention to provide a method for operating a jack.

These, together with the various ancillary objects and features which will become apparent to those skilled in the art as the following description proceeds, are attained by this novel adaptor and process, a preferred embodiment being shown with reference to the accompanying drawings, by way of example only, wherein:

BRIEF DESCRIPTION OF THE DRAWINGS

FIG. 1 is a perspective view of the adaptor engaged to a jack;

FIG. 2 is a partial vertical sectional view of the drive shaft of the adaptor engaged to a threadable jack shaft that rotatably passes through a support-aligning bar and the engagement bracket of the adaptor engaged releasably to the support-aligning bar with the dotted lines for the engagement bracket representing the pivotal position for the engagement bracket to engage or to release from the support-aligning bar while being pivoted against the face of the adaptor housing;

FIG. 3 is a top plan view of the adaptor engaged to the support-aligning bar;

FIG. 4 is a vertical sectional view taken in direction of the arrows and along the plane of line 4—4 in FIG. 3.

FIG. 5 is a vertical sectional view taken in direction of the arrows and along the plane of line 5—5 in FIG. 4;

FIG. 6 is a front elevational view taken in direction of the arrows and along the plane of line 6—6 in FIG. 4;

FIG. 7 is a perspective view of one embodiment of the engagement bracket;

FIG. 8 is a schematic wiring diagram for the adaptor;

FIG. 9 is a partial sectional view of the engagement bracket engaged against the support-aligning bar and pivoted against the face of the adaptor housing so that the drive shaft can be positioned to easily engage the end of the threadable jack shaft;

FIG. 10 is a partial sectional view of the engagement bracket whose pivot is being released such that the engagement bracket can be biased flushly against the face of the adaptor housing and of the drive shaft housing a female end slidably receiving the end of the threadable jack shaft;

FIG. 11 is a partial sectional view of a threadable jack shaft housing a female end that is mated with and has received a male end of a drive shaft and of the engagement bracket secured partiallly around the support-aligning bar while being biased flushly against the face of the adaptor housing;

FIG. 12 is a partial vertical sectional view of an end of another embodiment of the engagement bracket; and FIG. 13 is a front elevational view of the end of the embodiment of the engagement bracket in FIG. 12.

DETAILED DESCRIPTION OF THE INVENTION

Referring in detail now to the drawings wherein similar parts of the invention are identified by like reference numerals, there is seen an adaptor, generally illustrated as 10, for engagement to a conventional screw-type scissor style or bottle jack, generally illustrated as 12 (see FIG. 1), which is used to raise or lower a vehicle (not shown in the drawings).

The jack 12 generally has a jack base 14, a pair of generally parallel collapsible brackets 16—16 pivotally attached to the jack base 14, and a support platform 18 also pivotally secured to the pair of brackets 16—16 and functions to engage part of a vehicle which is to be raised or lowered. A pair of spacer bars or support-aligning bars 20—20 connect to the pair of collapsible brackets 16—16. The bars 20—20 may have different geometric configurations, such as round in cross section and as a cylindrical bar in FIGS. 1-3, 9-11, and as a square in cross section and as a rectangular bar in FIGS. 12 and 13. No matter what the configurations of the bars 20—20 are, each bar 20 has a threaded aperture 22 wherethrough a threadable jack shaft 24 passes rotatably such that when the jack shaft 24 rotates in a predetermined direction (e.g. clockwise) the two support-aligning bars 20—20 are pulled towards each other by the jack shaft 24. This causes the pair of collapsible brackets 16—16 to become longer (or expand) lengthwise which results in the support platform 18 (and any vehicle engaged thereto) traveling or moving upwardly. When the jack shaft 24 rotates in a direction opposite (e.g. counter-clockwise) to the predetermined direction, the two support-aligning bars 20—20 are pushed apart and away with respect to each other, causing the pair of collapsible brackets 16—16 to become shorter (or contract) lengthwise and the support platform 18 (and any vehicle supported thereby) to travel or move downwardly.

The adaptor 10 has a adaptor housing 26 with a housing face 28. A drive motor 30 is positioned or disposed in the housing 26 and has a rotatable motor shaft 32 that rotates when the drive motor 30 electrically communicates with an electrical power source (e.g. a 12 V battery of a vehicle) through a conductor 34 having a three-way switch 35 and at an end a power connector 36 that slidably connects into a cigarette lighter (not shown) of the vehicle having the battery-power source. A gear 38 is integrally bound to the motor shaft 32 in order to rotate when the latter rotates. Meshed or mating with gear 38 is gear 40 that rotates when gear 38 is being rotated by an operating motor shaft 32. Gear 38 has a smaller diameter (or short circumference) than gear 40 in order to increase torque and reduce the number of revolutions of gear 40 with respect to gear 38. Integrally bound or connected to gear 40 is a drive shaft 42 that rotatably passes through the face 28 of the housing 26 and rotates with gear 40. Drive shaft 42 may either have a female end 44 (as illustrated in FIGS. 2, 4, 9 and 10) or a male end 46 (as illustrated in FIG. 11).

The ends 44 or 46 of the drive shaft 42 releasably engage an end of the threadable jack shaft 24; therefore, correspondingly, threadable jack shaft 24 has either a male end 48 which mates with and receives the female end 44 of the drive shaft 42, or a female end 50 (see FIG. 11) which mates with and receives the male end 46 of the drive shaft 42.

The adaptor 10 also comprises an engagement bracket, generally illustrated as 50, for engaging releasably the adaptor 10 to the jack 12 (more specifically to one of the support-aligning bars 20 of the jack 12) and to prevent the adaptor 10 from turning under torque while the drive shaft 42 is engaged to and rotates the threadable jack shaft 24 to thereby raise or lower the support platform 18 of the jack 12. The engagement bracket 52 has a structure defining a generally straight body portion 54 terminating at one end in an upright back portion 56 integrally bound normally to the straight body portion 54 and terminating at another end into a bifurcated end having a pair of bracket arms 58—58 wherethrough or between which thee threadable jack shaft 24 passes when the adaptor 10 (i.e. more specifically the bifurcated end of the adaptor 10) is engaged to the jack 12 (i.e. more specifically the support-aligning bar 20 of the jack 12). Bracket arms 58—58 have a pair of embodiments with respect to shape and depend on the particular geometric shape of the support-aligning bar 20. If this support-aligning bar 20 has a round in cross section, cylindrical bar-like configuration (such as disclosed in FIGS. 1-3, 9-11), the bracket arms 58—58 are integrally bound to the straight body portion 54 and extend downwardly and/or away therefrom with generally an arcuate shape as shown in FIGS. 2, 3 and 7. If the support-aligning bar 20 has a square in cross-section, rectangular bar-like configuration (such as disclosed in FIGS. 12 and 13), the bracket arms 58—58 are integrally bound to the straight body portion 54 in a generally normal (or perpendicular) position with respect thereto (as shown in FIGS. 12 and 13). In the latter shape embodiment for the bracket arms 58—58, the perpendicular bracket arms 58—58 each terminate in a flange 60 (see FIG. 12).

As indicated, the straight body portion 54 has the upright back portion 56 integrally attached thereto normally or perpendicularly. The upright back portion 56 has a structure defining a pair of back apertures 62—62 (see FIG. 7) wherethrough a pair of spring loaded bolts, each generally illustrated as 64, passes and secure to the face 28 of the adaptor housig 26. Each spring loaded bolt 64 provides a means for securing and biasing the engagement bracket 52 to the face 28 of the housing 26. Each spring loaded bolt 64 comprises a bolt 66 having a flanged heat 68 and passing through the aperture 62 and engaged to the face 28 of the housing 26, and a spring 70 wound around the bolt 66 and compressing against the flanged heat 68 of the bolt 66 and against the upright back portion 56 to spring bias the engagement bracket 52 against the face 28 of the housing 26. When the engagement bracket 52 is pulled upwardly, such as to the dotted line position in FIG. 2, the upright back portion 56 slides away from being flushed against the face 28 of the housing 26 and further compresses springs 70—70 as indicated in FIGS. 9 and 10.

The drive motor 30 employed in the instant invention is preferably a 12-volt, d.c. geared motor with 3 to 600 rpm and a torque capacity of about 60 lbs.-n. The three-way switch 35 to turn the motor 30 "off" and "on" may be one of many different three-way designs with the basic premise of providing an "up" position (i.e. the motor 30 is energized such that the motor shaft 32 revolves in a predetermined direction to raise the support-platform 18 engaging vehicle); "down" position (i.e. the motor 30 is energized such that the motor shaft 32 revolves in a direction opposite the predetermined dirction of the "up" position to lower the support-platform 18); and a "neutral" position where the motor 30 is not energized to rotate the motor shaft 32 in any direction.

With continuing reference to the drawings for operation of the invention and the method for operating the jack 12, the engagement bracket 52 is raised or moved upwardly to the dotted line position of FIG. 2, causing the top part or top edge of the upright back portion 56 of the engagement bracket 52 to pivot against the face 28 of the housing 26, as illustrated in FIG. 9 and by 10 the dotted lines in FIG. 2. Subsequently, the bracket arms 58—58 are positioned around one of the support-aligning bars 20 such that the threadable jacke shaft 24 passes through or between the bracket arms 58—58, as illustrated in FIGS. 9 and 13. Positioning the bracket arms 58—58 as such is taking place simultaneously and while the engagement bracket 52 is being pivoted against the face 28 of the housing 26. The drive shaft 42 is aligned as illustrated in FIG. 10 to readily be engaged by or to engage an end (i.e. either a male end 48 or a female end 50, depending on whether drive shaft 42 has the male end 46 or the female end 44) of the threadable jack shaft 24. After the drive shaft 42 has been positioned as such with respect to threadable jack shaft 24, the pivot of the engagement bracket 52 from against the face 28 of the housing 26 is released such that there is full engagement of the drive shaft 42 with the threadable jack shaft 24 and the spring loaded bolts 64 flushly bias the planor surface of the upright back portion 56 against the face 28 of housing 26 as illustrated in FIGS. 2, 3 and 11. The adaptor 10 has now been engaged to the jack 12, and when the connector 36 is inserted into a cigarette lighter of a vehicle and the switch 35 is switched to the "on" position, electrical power is supplied to the drive motor 30 in order to cause the threadable jack shaft 24 to rotate in a predetermined direction (via the gears 38 and 40 and drive shaft 42 taking and receiving rotary power from a rotating motor shaft 32) to thereby cause the pair of support-aligning bars to be pulled towards each other and raise the support platform 18 of the jack 12 while engaged underneath a vehicle. After the vehicle has reached a certain height (e.g. such as a height to facilitate the changing of a tire), the switch 35 is positioned into the neutral position, terminating electrical power to the drive motor 30 in order to stop the rotation of the threadable jack shaft 24 and upward movement of the support platform 18.

The support platform 18 can be lowered by switching the switch 35 to the "down" postion, which causes electrical power to be supplied to the drive motor 30 in order to cause the threadable jack shaft 24 to rotate in a direction opposite (via again gears 38–40 and drive shaft 42 taking and receiving rotary power from a rotating motor shaft 32) to the predetermined direction of the "up" position. After the support platform 18 has been lowered to no longer engage the vehicle, the engagement bracket 52 is disconnected from the support-aligning bar 20 and the drive shaft 42 is disengaged from the threadable jack shaft 24. These disconnections and/or disengagements are more specifically accomplished by pivoting the engagement bracket (i.e. more specifically the top part or the top edge of the upright back portion 56) against the face 28 of the housing 26 such that the pair of spring loaded volts 64—64 do not flushly bias the planor surface of the upright back portion 56 of the engagement bracket 52 against the face 28 of the housing 26, as illustrated in FIGS. 9 and by the dotted lines in FIG. 2. Subsequently, the drive shaft 42 is released from being engaged with the threadable jack shaft 24 by merely pulling the two members apart such that one female fitting of one member is released from being around the male fitting of the other member. After the drive shaft 42 and the threadable jack shaft 24 are completely released from each other, the pair of bracket arms 58—58 of the engagement bracket 52 is released from against the support-aligning bars 20, while the engagement bracket 52 (i.e. more specifically the top part of the top edge of the upright back portion 56) is pivoted against the face 28 of the housing 26. Finally, the pivot of the engagement bracket 52 is released from against the face 28 of the housing 26, resulting in the pair of spring loaded bolts 64—64 flushly biasing the planar surface of the upright back portion 56 of the engagement bracket 52 against the face 28 of the housing 26, as illustrated in FIG. 4.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A jack and an adaptor in combination comprising a jack base; a pair of general parallel collapsible brackets pivotally secured to said jack base; support platform means secured pivotally to the pair of collapsible brackets; a pair of support-aligning bars connected to said pair of collapsible brackets with each support-alinging bar having a structure defining a threaded aperture a threadable jack shaft passing rotatably through the threaded aperture of each support-aligning bar such that when the threadable jack shaft rotates in a predetermined direction the two support-aligning bars are pulled towards each other causing the pair of collapsible brackets to become longer lengthwise and the support platform means to travel upwardly and such that further when the threadable jack shaft rotates in a direction opposite the predetermined direction the two support-aligning bars are pushed apart with respect to each other causing the pair of collapsible brackets to become shorter lengthwise and the support platform means to travel downwardly; an adaptor housing; a drive motor means disposed in said adaptor housing; a drive shaft means releasably engaged to said threadable jack shaft to rotate the same and coupled to said drive motor means; an engagement bracket means for engaging releasably the adaptor to one of the support-aligning bars of the jack and to prevent the adaptor from turning while the drive shaft is rotating the threadable jack shaft; and means for securing and biasing the engagement bracket means against the face of the adaptor housing; said engagement bracket means comprises a structure defining a bifurcated end having a pair of bracket arms where between the threadable jack shaft passes when the adaptor is engaged to one of the support-aligning bars; said structure of said engagement bracket means additionally defines a generally straight body portion and an upright back portion integrally bound normally to said straight body portion; and said upright baack portion has a structure defining at least one aperture, and said means for securing and biasing passes through said aperture for biasingly securing the engagement bracket means to the face of the housing.

2. The jack and adaptor combination of claim 1 wherein said pair of bracket arms is integrally bound to said straight body portion in a generally normal position with respect thereto.

3. The jack and adaptor combination of claim 2 wherein each bracket arm of said pair of bracket arms terminate in flange.

4. The jack and adaptor combination of claim 1 wherein said upright back portion has a pair of apertures and said means for securing and biasing comprises a pair of bolts respectively passing through said apertures and engaged to the face of the housing, and a spring wound around each of the bolts and compressing against the upright back portion to spring bias the engagement bracket means against the face of the housing.

* * * * *